US010531778B2

(12) United States Patent
Youk et al.

(10) Patent No.: US 10,531,778 B2
(45) Date of Patent: Jan. 14, 2020

(54) VACUUM CLEANER

(71) Applicant: LG Electronics Inc., Seoul (KR)

(72) Inventors: Hyungkyu Youk, Seoul (KR); Sangjo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 136 days.

(21) Appl. No.: 15/747,166

(22) PCT Filed: Aug. 23, 2016

(86) PCT No.: PCT/KR2016/009280
§ 371 (c)(1),
(2) Date: Jan. 24, 2018

(87) PCT Pub. No.: WO2017/034286
PCT Pub. Date: Mar. 2, 2017

(65) Prior Publication Data

US 2018/0213991 A1 Aug. 2, 2018

(30) Foreign Application Priority Data

Aug. 24, 2015 (KR) ..... 10-2015-0119138

(51) Int. Cl.
*A47L 9/28* (2006.01)
*A47L 5/36* (2006.01)
*A47L 9/00* (2006.01)

(52) U.S. Cl.
CPC ..... *A47L 9/2852* (2013.01); *A47L 5/362* (2013.01); *A47L 9/009* (2013.01)

(58) Field of Classification Search
CPC ..... A47L 9/2852; A47L 5/362; A47L 9/009; A47L 5/30; A47L 5/00; A47L 5/10;
(Continued)

(56) References Cited

U.S. PATENT DOCUMENTS 4,799,564 A * 1/1989 Iijima ..... B60K 7/0007 180/65.51
9,958,031 B2 5/2018 Park et al.
(Continued)

FOREIGN PATENT DOCUMENTS

EP 2865311 4/2015
KR 200417686 5/2006
(Continued)

OTHER PUBLICATIONS

International Search Report in International Application No. PCT/KR2016/009280, dated Dec. 6, 2016, 2 pages (with English translation).

*Primary Examiner* — Robert J Scruggs
(74) *Attorney, Agent, or Firm* — Fish & Richardson P.C.

(57) ABSTRACT

A vacuum cleaner includes a cleaner body; a suction unit connected with the cleaner body, sucking dust and air, guiding the sucked dust and air to the cleaner body, and having a handle; a moving unit including a wheel and a motor for driving the wheel to automatically move the cleaner body; and a clutch unit connecting the motor and the wheel or releasing the connection of the motor and the wheel according to an operational state of the cleaner body. The clutch unit includes a sun gear connected with the motor, a ring gear connected with the wheel, a plurality of fixed planetary gears disposed to be spaced apart each other between the sun gear and the ring gear, and a moving planetary gear which may transmit a rotational force transmitted to the sun gear to one gear of the plurality of fixed planetary gears.

20 Claims, 6 Drawing Sheets

(58) Field of Classification Search
CPC . A47L 5/32; A47L 9/0411; A47L 5/34; A47L 5/26; B62D 63/08; B60K 7/00
See application file for complete search history.

(56) References Cited

U.S. PATENT DOCUMENTS

| | | | | |
|---|---|---|---|---|
| 2004/0134019 | A1* | 7/2004 | Cipolla | A47L 5/28 15/340.2 |
| 2008/0302586 | A1* | 12/2008 | Yan | A47L 9/009 180/24.08 |
| 2010/0299867 | A1* | 12/2010 | Beskow | A47L 9/0427 15/390 |
| 2013/0186725 | A1 | 7/2013 | Beskow et al. | |

FOREIGN PATENT DOCUMENTS

| | | |
|---|---|---|
| KR | 10-2015-0033554 | 4/2015 |
| KR | 10-2015-0048488 | 5/2015 |

* cited by examiner

[Fig. 1]
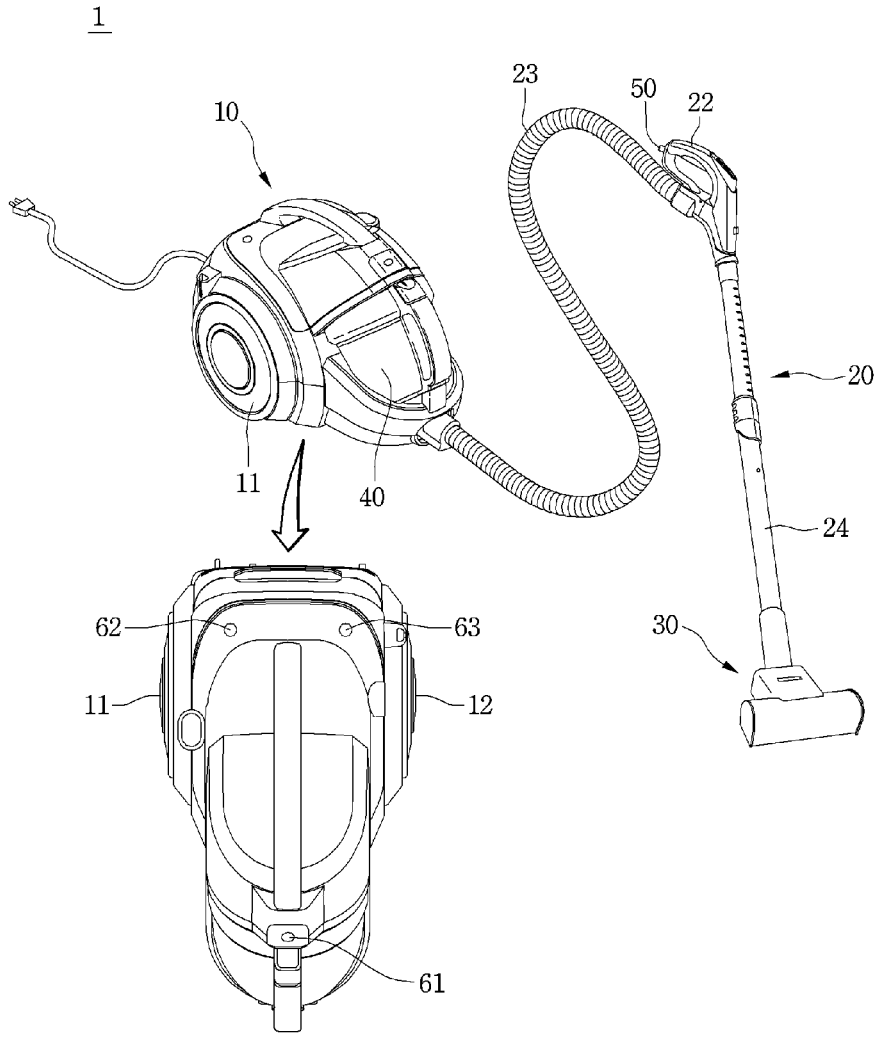
[Fig. 2]
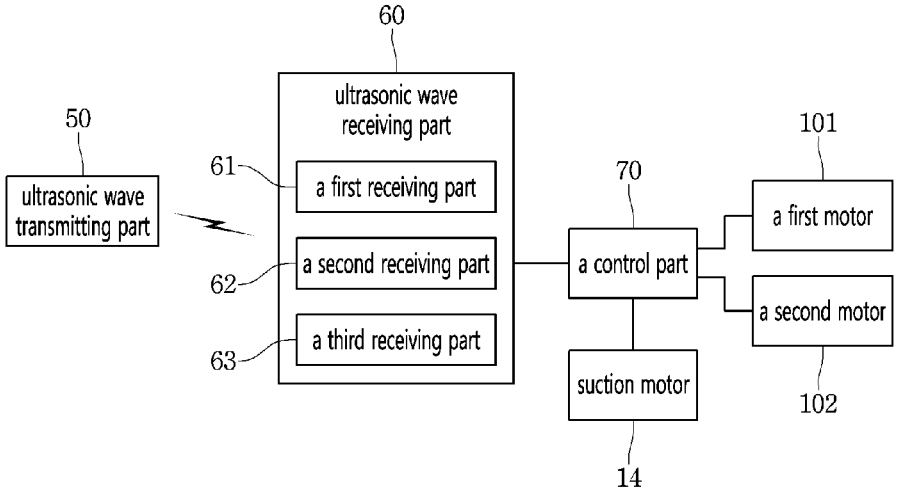

[Fig. 3]
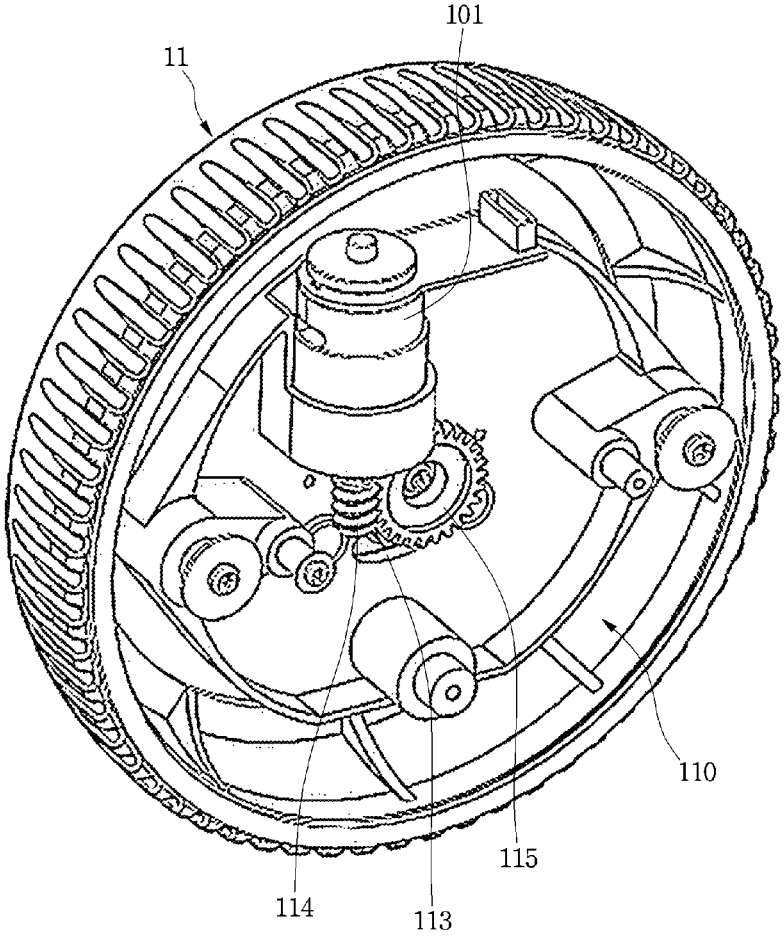

[Fig. 4]
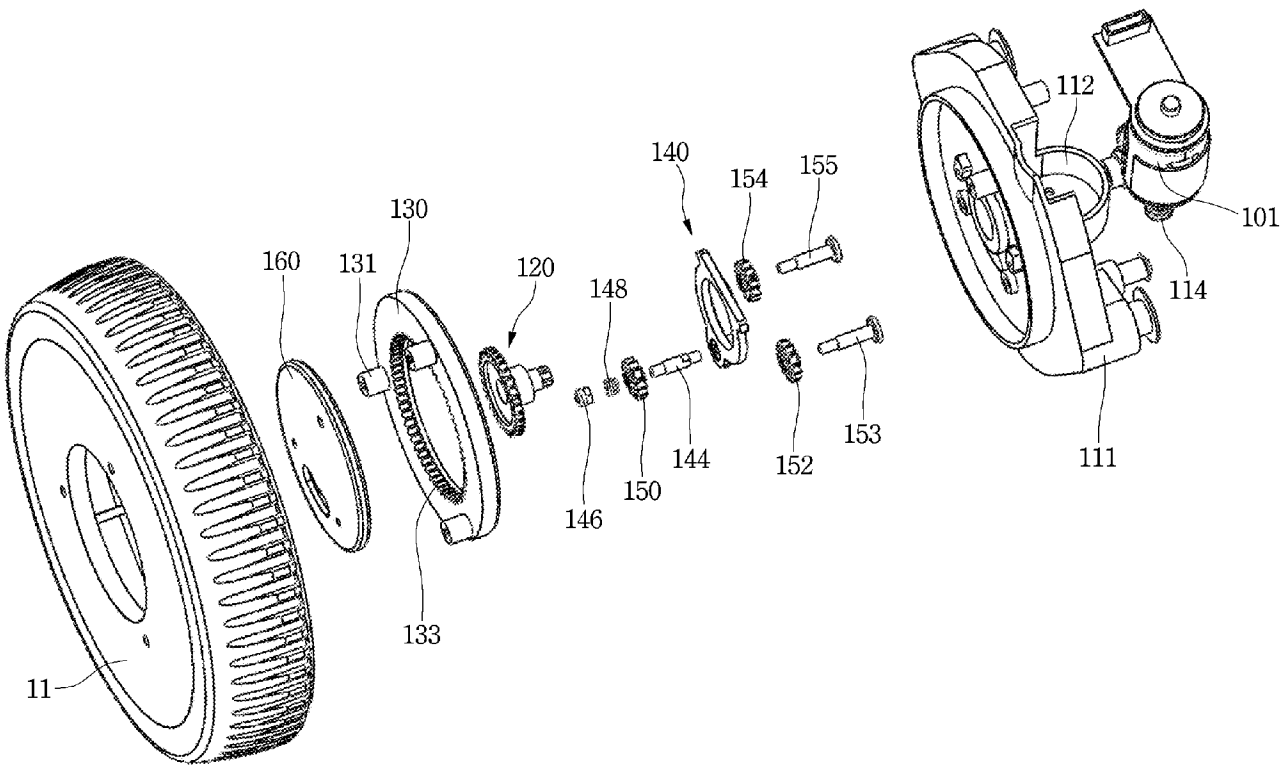

[Fig. 5]
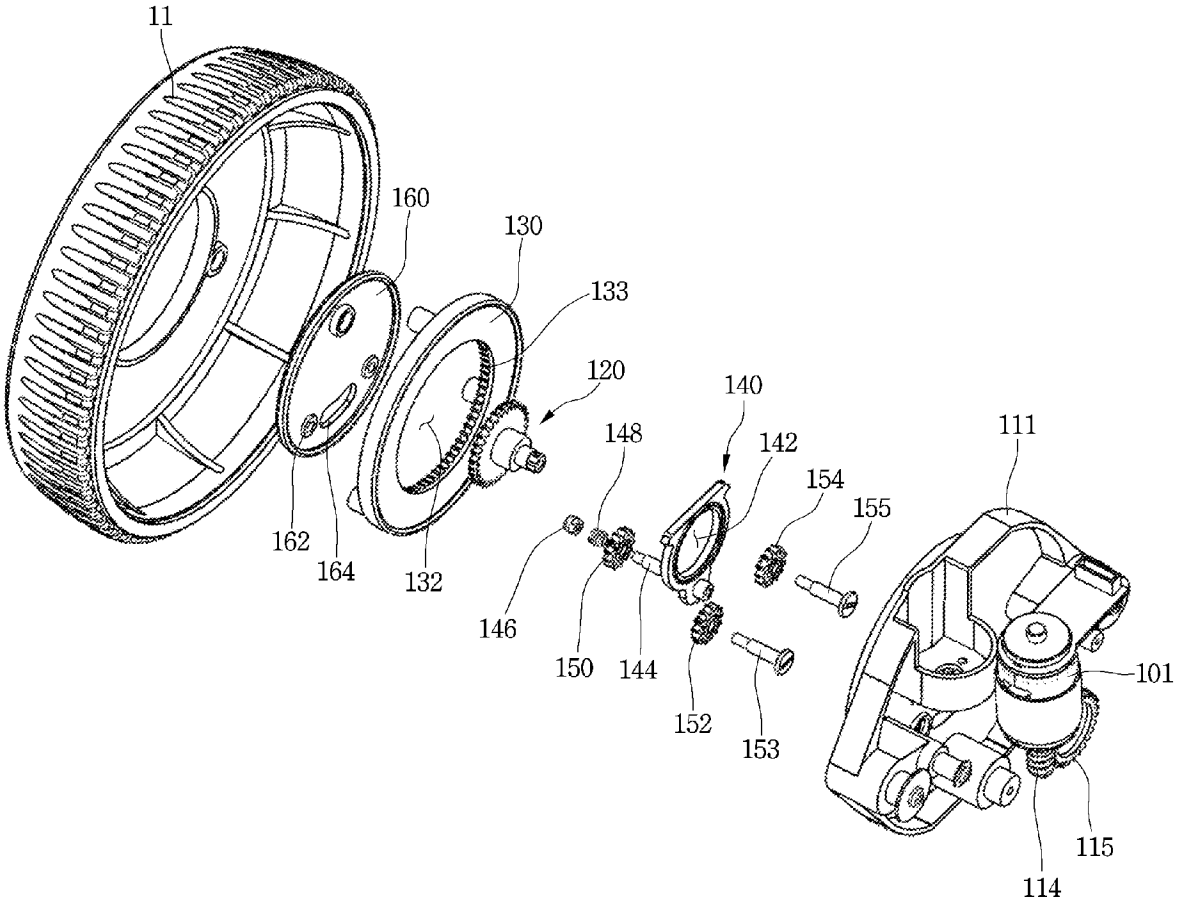

[Fig. 6]
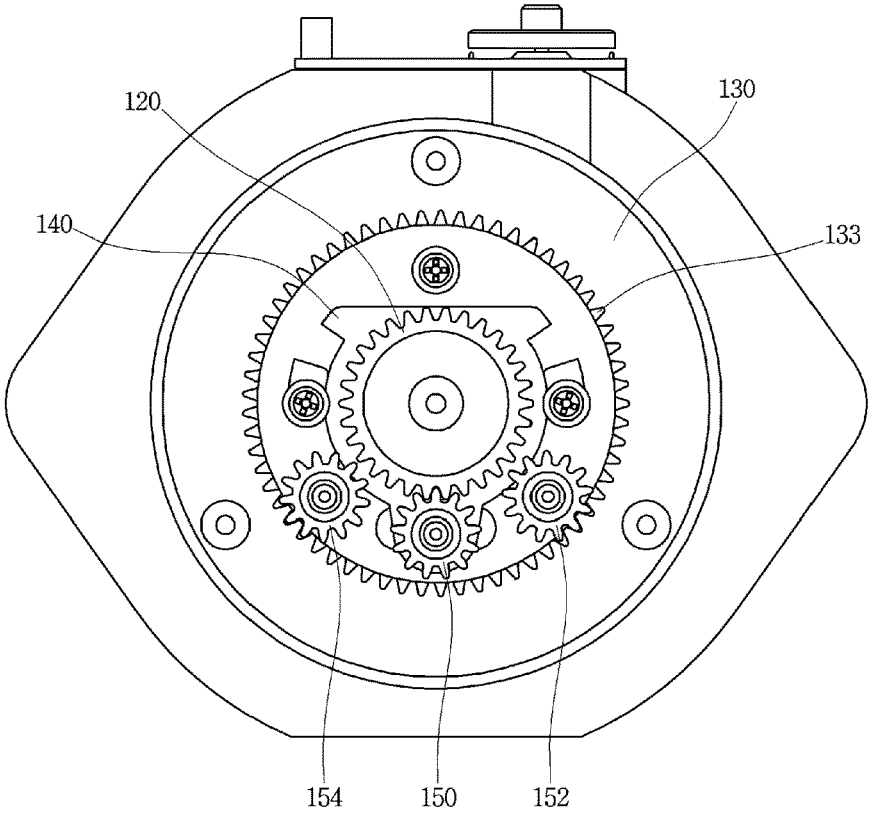
[Fig. 7]
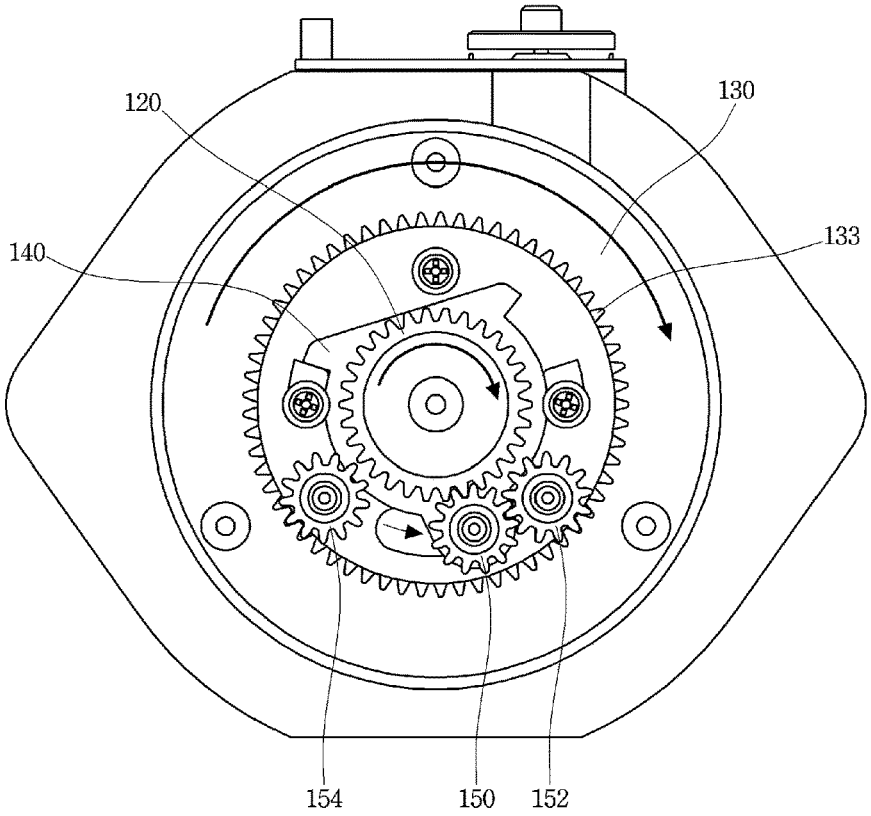

[Fig. 8]
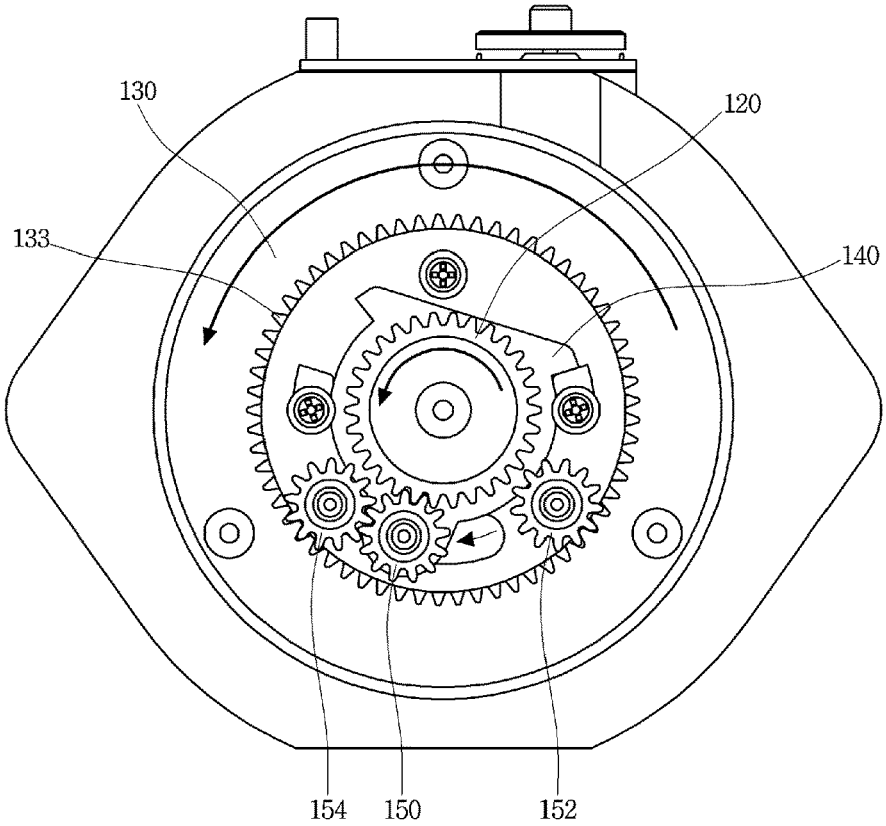
[Fig. 9]
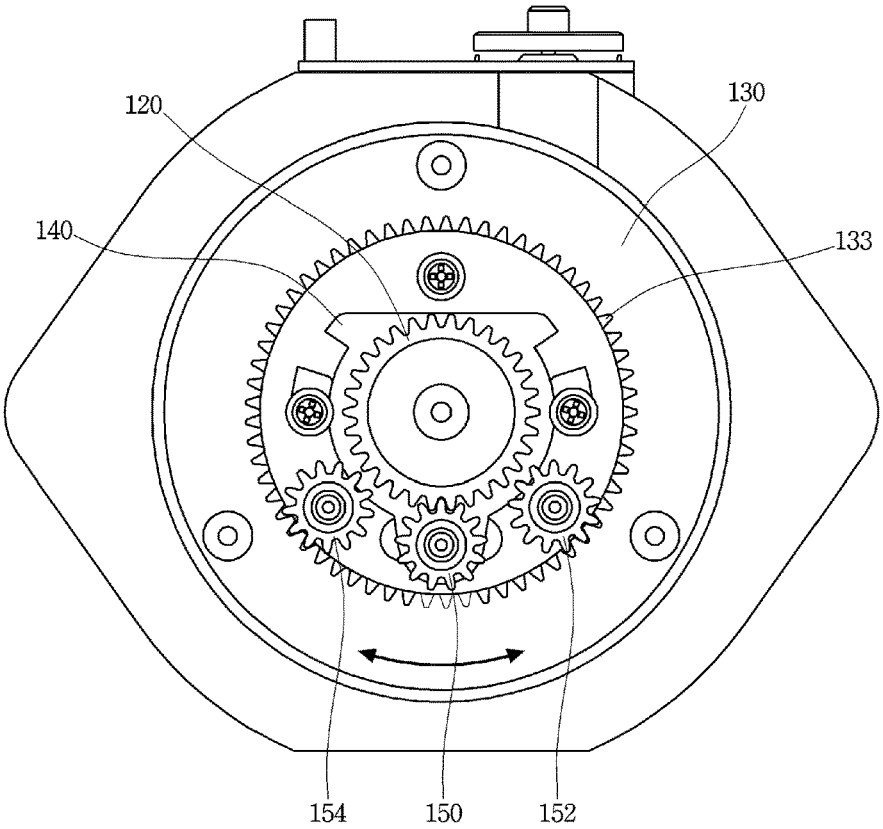

VACUUM CLEANER

CROSS REFERENCE TO RELATED APPLICATIONS

This application is a U.S. National Phase Application under 35 U.S.C. § 371 of International Application PCT/KR2016/009280, filed on Aug. 23, 2016, which claims the benefit of Korean Application No. 10-2015-0119138, filed on Aug. 24, 2015, the entire contents of which are hereby incorporated by reference in their entireties.

TECHNICAL FIELD

A vacuum cleaner is disclosed herein.

BACKGROUND ART

Generally, a vacuum cleaner is an apparatus which suctions dust and foreign substances scattered on a surface to be cleaned using a suction motor installed inside a main body, and filters the dust and the foreign substances in the main body.

The vacuum cleaner having such a function may be classified into an up-right type in which a suction nozzle is integrally formed with the main body, and a canister type in which the suction nozzle is in communication with the main body through a connection pipe.

Meanwhile, in Korean Patent Publication No. 2010-0053098 (published on May 20, 2010), there is disclosed a vacuum cleaner.

The vacuum cleaner includes a wheel which enables a cleaner body to be easily moved, and a driving part which drives the wheel. The vacuum cleaner detects a rotational and translational motion of a moving member, and controls an operation of the driving part.

A motor configuring the driving part is directly connected to the wheel or connected by a power transmission part.

In the case of the vacuum cleaner, in the process that a user turns on the vacuum cleaner and performs a cleaning, the wheel is rotated by the driving part, and thus the vacuum cleaner may automatically move forward or backward.

However, while the vacuum cleaner is stopped, since a state in which the driving part is connected to the wheel is maintained, the wheel is not able to be rotated smoothly due to a resistance by the driving part itself or the power transmission part, and thus the user has a difficulty in moving the vacuum cleaner.

DISCLOSURE OF INVENTION

Technical Problem

The present invention is directed to providing a vacuum cleaner in which a cleaner body is able to move, and to follow a user when the cleaner body is operated.

The present invention is also directed to providing a vacuum cleaner in which power of a motor may be mechanically transmitted to a wheel by a clutch unit without control of the clutch unit when the cleaner body is operated.

Solution to Problem

The present invention is also directed to providing a vacuum cleaner in which a user may easily manually move a cleaner body regardless of a direction of movement of the cleaner body while the operation of the cleaner body is stopped.

One aspect of the present invention provides a vacuum cleaner including a cleaner body; a suction unit connected to the cleaner body, sucking dust and air and guiding the sucked dust and air to the cleaner body, and having a handle; a moving unit including a wheel and a motor for driving the wheel in order to automatically move the cleaner body; and a clutch unit connecting the motor and the wheel or releasing the connection of the motor and the wheel according to an operational state of the cleaner body.

The clutch unit may include a sun gear connected to the motor, a ring gear connected to the wheel, a plurality of fixed planetary gears disposed to be spaced apart each other between the sun gear and the ring gear, and a moving planetary gear which may transmit a rotational force transmitted to the sun gear to one gear of the plurality of fixed planetary gears.

The moving planetary gear may be positioned between the plurality of fixed planetary gears.

The moving planetary gear may be connected to the sun gear, and may be spaced apart from a gear tooth of the ring gear.

Each of the plurality of fixed planetary gears may be engaged with the gear tooth of the ring gear, and may be spaced apart from the sun gear.

A shortest distance between the plurality of fixed planetary gears may be formed larger than a diameter of the moving planetary gear.

The plurality of the fixed planetary gears may include a first fixed planetary gear and a second fixed planetary gear connected to the ring gear.

The moving planetary gear may be connected to any one of the first and the second fixed planetary gears, or the connection with both of the two fixed planetary gears may be released.

When the motor is rotated in a first direction, the moving planetary gear and the first fixed planetary gear may be connected, and when the motor is rotated in a second direction opposite to the first direction, the moving planetary gear and the second fixed planetary gear may be connected.

In the case in which a force for reversing the cleaner body is acted by a user while the moving planetary gear and the first fixed planetary gear are connected, the moving planetary gear may be spaced apart from the first fixed planetary gear.

In the case in which a force for advancing the cleaner body is acted by the user while the moving planetary gear and the second fixed planetary gear are connected, the moving planetary gear may be spaced apart from the second fixed planetary gear.

The clutch unit may further include an operation member which supports the moving planetary gear and may be rotated around a center of the sun gear.

By the rotation of the operation member, the moving planetary gear may move to a position connected with any one of the first and the second fixed planetary gears or may move to a position not connected with either of the two fixed planetary gears.

The clutch unit may further include a friction imparting member so that a contact friction force of the moving planetary gear and the operation member is maintained in a constant frictional force.

The friction imparting member may be a resilient member pressing the moving planetary gear in a direction in which the moving planetary gear and the operation member become closer.

The friction imparting member may be disposed between the moving planetary gear and the operation member, and may be formed of a rubber material.

The operation member may include a shaft rotatably supporting the moving planetary gear.

The clutch unit may further include a guide member having a guide slot guiding the shaft when the operation member is rotated around the center of the sun gear.

A motor supporter supporting the motor and fixed to the cleaner body may be further included, and the motor supporter may include a guide slot guiding the shaft when the operation member is rotated around the center of the sun gear.

A control part controlling the motor may be further included. When the operation of the cleaner body is stopped while the motor is rotating in the first direction in the operating process of the cleaner body, the control part may control the motor so that the motor is stopped after being rotated for a predetermined angle or predetermined time in the second direction opposite to the first direction.

Another aspect of the present invention provides a vacuum cleaner including a cleaner body; a suction unit connected to the cleaner body, sucking dust and air and guiding the sucked dust and air to the cleaner body, and having a handle; a moving unit including a wheel and a motor for driving the wheel in order to automatically move the cleaner body; a sun gear which may receive power from the motor; a ring gear connected with the wheel, a first fixed planetary gear disposed between the sun gear and the ring gear; a second fixed planetary gear disposed to be spaced apart from the first fixed planetary gear between the sun gear and the ring gear; and a moving planetary gear connected with the first fixed planetary gear when the motor is rotated in a first direction, and connected with the second fixed planetary gear when the motor is rotated in a second direction opposite to the first direction.

An operation member to which the moving planetary gear is rotatably connected and which may be rotated around a center of the sun gear may be further included.

A friction imparting member in order to maintain a contact friction force of the moving planetary gear and the operation member in a constant friction force may be further included.

The fiction imparting member may press the moving planetary gear to the operation member side, or be disposed between the moving planetary gear and the operation member, and may be formed of a rubber material.

The moving planetary gear may be spaced apart from the ring gear, and each of the fixed planetary gears may be spaced apart from the sun gear.

The moving planetary gear may be positioned between the first fixed planetary gear and the second fixed planetary gear, and a shortest distance between the first fixed planetary gear and the second fixed planetary gear may be formed larger than a diameter of the moving planetary gear.

Advantageous Effects of Invention

According to the proposed invention, in the case in which the cleaner body is operated, since power of the motor is transmitted to the wheel by the clutch unit and the cleaner body may move to follow the movement of the user, the user does not need to move the cleaner body directly, and thus there is an advantage that the convenience of the user is improved.

In addition, during the operation of the cleaner body, since power of the motor may be transmitted to the wheel by the clutch unit without the control of the clutch unit, the cleaner body may move to follow the user.

Therefore, there is an advantage that the control configuration for operating the clutch unit is unnecessary.

In addition, while the operation of the vacuum cleaner is stopped, as the connection between the motor and the wheel is released by the clutch unit, the wheel for the motor is in an idle state, and accordingly the user may manually move the cleaner body easily.

In particular, while the operation of the cleaner body is stopped, as the clutch unit releases power of the motor and the wheel by a reverse rotation of the motor, there is an advantage that the cleaner body may be smoothly moved manually by the user regardless of the direction of movement of the cleaner body.

BRIEF DESCRIPTION OF DRAWINGS

FIG. 1 is a perspective view of a vacuum cleaner according to an embodiment of the present invention;

FIG. 2 is block diagram of the vacuum cleaner according to an embodiment of the present invention;

FIG. 3 is a view illustrating a clutch unit according to an embodiment of the present invention;

FIG. 4 and FIG. 5 are exploded perspective views of the clutch unit of FIG. 3;

FIG. 6 is a view illustrating the arrangement of gears including the clutch unit of FIG. 3;

FIG. 7 is a view illustrating the operation of the clutch unit when the vacuum cleaner according to an embodiment of the present invention moves forward;

FIG. 8 is a view illustrating the operation of the clutch unit when the vacuum cleaner according to an embodiment of the present invention moves backward; and FIG. 9 is a view illustrating the connection of a motor and a wheel is released by the clutch unit.

MODE FOR THE INVENTION

Reference will now be made in detail to the embodiments of the present disclosure, examples of which are illustrated in the accompanying drawings.

Hereinafter, exemplary embodiments of the present disclosure will be described with reference to the accompanying drawings. Regarding the reference numerals assigned to the elements in the drawings, it should be noted that the same elements may be designated by the same reference numerals, wherever possible, even though they are shown in different drawings. Also, in the description of embodiments, detailed description of well-known related structures or functions may be omitted when it is deemed that such description may cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled" or "joined" to the latter or "connected," "coupled" or "joined" to the latter via another component.

FIG. 1 is a perspective view of a vacuum cleaner according to an embodiment of the present invention, and FIG. 2 is block diagram of the vacuum cleaner according to an embodiment of the present invention.

Referring to FIG. 1 and FIG. 2, a vacuum cleaner 1 according to an embodiment of the present invention may include a cleaner body 10 having a suction motor 14 for generating a suction force, and a suction unit 20 connected to the cleaner body 10 and sucking air and foreign substances of a floor surface.

The cleaner body 10 may include a moving unit for movement of the cleaner body 10.

The moving unit may include a plurality of wheels 11 and 12. In one example, the plurality of wheels 11 and 12 may be disposed on both sides of the cleaner body 10. The plurality of wheels 11 and 12 may include a first wheel 11 disposed at a right side in a direction to move forward from the cleaner body 10, and a second wheel 12 disposed at a left side thereof.

A dust container 40 in which dust separated from the air is stored may be detachably connected to the cleaner body 10.

The suction unit 20 may include a suction nozzle 30 which may move along the floor surface, and a connection unit for connecting the suction nozzle 30 to the cleaner body 10.

The connection unit may include an extension pipe 24 connected to the suction nozzle 30, a handle 22 connected to the extension pipe 24, and a connection hose 23 connecting the handle 22 to the cleaner body 10.

The moving unit may further include a plurality of motors 101 and 102 for rotating the plurality of wheels 11 and 12, respectively. The plurality of motors 101 and 102 may include a first motor 101 and a second motor 102.

The first motor 101 may rotate the first wheel 11, and the second motor 102 may rotate the second wheel 12.

Each of the motors 101 and 102 may be operated independently. By an independent operation of each of the motors 101 and 102, the cleaner body 10 may be automatically moved forward or backward, and may also turn left and right.

The vacuum cleaner 1 may further include an ultrasonic wave transmitting part 50 transmitting an ultrasonic wave, and an ultrasonic wave receiving part 60 receiving the ultrasonic wave transmitted from the ultrasonic wave transmitting part 50.

The ultrasonic wave transmitting part 50 may be located at the suction unit 20. The ultrasonic wave transmitting part 50 may be located at the handle 22 or the suction nozzle 30, but is not limited thereto.

The ultrasonic wave receiving part 60 may be disposed at the cleaner body 10. The ultrasonic wave receiving part 60 may include a plurality of receiving parts 61, 62 and 63. Each of the plurality of receiving parts 61, 62 and 63 may receive the ultrasonic wave transmitted from the ultrasonic wave transmitting part 50

When the plurality of receiving parts 61, 62 and 63 are horizontally or vertically projected, lines which connect the plurality of receiving parts 61, 62 and 63 may form a polygon.

For example, the plurality of receiving parts 61, 62 and 63 may include a first receiving part 61, a second receiving part 62 and a third receiving part 63.

When the first to third receiving parts 61, 62 and 63 are horizontally or vertically projected, lines which connect the first to third receiving parts 61, 62 and 63 may form a triangle.

A part of the first to third receiving parts 61, 62 and 63 may be disposed to have a height different from that of the other part thereof. Also, two of the first to third receiving parts 61, 62 and 63 may be disposed to be horizontally spaced.

The vacuum cleaner 1 may further include a control part 70 controlling the first motor 101 and the second motor 102.

The control part 70 determines a location of the ultrasonic wave transmitting part 50 based on the ultrasonic wave received in the ultrasonic wave receiving part 60, and may operate one or more of the first motor 101 and the second motor 102 when it is necessary to move the cleaner body 10 toward the ultrasonic wave transmitting part 50 of which the location is determined.

In the case in which the ultrasonic wave transmitting part 50 is disposed at the handle 22, when a cleaning operation is performed while moving the handle 22, the ultrasonic wave transmitting part 50 is moved along with the handle 22. In this case, the distance between the ultrasonic wave transmitting part 50 and the cleaner body 10 (or the ultrasonic wave receiving part 60) may be varied.

A movable distance of the handle 22 corresponds to a length of the connection hose 23, and when the handle 22 is spaced apart from the cleaner body 10 in a predetermined distance, a force of moving the handle 22 is applied to the cleaner body 10, and thus the cleaner body 10 is moved forward.

When the vacuum cleaner 1 is turned on in the present embodiment, in other words, when an operation command of the suction motor 14 is input, each of the motors 101 and 102 is in an operational state.

In this state, when the distance from the ultrasonic wave transmitting part 50 to the cleaner body 10 is increased, the control part 70 may control the first motor 101 and the second motor 102 so that the cleaner body 10 may move toward the handle 22.

However, when the operation of the vacuum cleaner 1 is stopped, in other words, when an operation stop command of the suction motor 14 is input, each of the motors 101 and 102 is maintained in a suspended state.

In the present embodiment, a user's movement is detected by using the ultrasonic wave transmitting part 50 and the ultrasonic wave receiving part 60, but in the present invention, there is no limit in a structure and a method for detecting the user's movement.

FIG. 3 is a view illustrating a clutch unit according to an embodiment of the present invention, FIG. 4 and FIG. 5 are exploded perspective views of the clutch unit of FIG. 3, and FIG. 6 is a view illustrating the arrangement of gears including the clutch unit of FIG. 3.

Referring to FIG. 1 to FIG. 6, when the operation of the cleaner body 10 is stopped, the user should directly move the cleaner body 10.

Therefore, the vacuum cleaner 1 according to the present embodiment may further include a clutch unit 110 connecting power of each of the motors 101 and 102 and each of the wheels 11 and 12 or may block the power connection so that the cleaner body 10 may move easily while the cleaner body 10 is stopped (while each of the motors 101 and 102 is stopped).

Hereinafter, a structure of the clutch unit 110 for transmitting power of the first motor 101 to the first wheel 11 is described with an example, and a structure for transmitting power of the second motor 102 to the second wheel 12 is the same as the structure of the clutch unit 110 described below.

The clutch unit 110 transmits the power of each of the motors 101 and 102 to each of the wheels 11 and 12 when each of the motors 101 and 102 is operating.

On the other hand, the clutch unit 110 releases the connection of each of the motors 101 and 102 and each of the wheels 11 and 12, while each of the motors 101 and 102 is in a suspended state.

While each of the motors 101 and 102 is in the suspended state, each of the wheels 11 and 12 is in an idle state with respect to each of the motors 101 and 102, and thus each of the wheels 11 and 12 may be smoothly rotated.

The clutch unit 110 may include a sun gear 120 receiving power from the first motor 101, a ring gear 130 coupled with the first wheel 11 and a plurality of planetary gears 150, 152 and 154 connecting the sun gear 120 and the ring gear 130 or releasing the connection.

A portion or all of the clutch unit 110 may be located in a space in which the first wheel 11 is formed, but is not limited thereto. That is, the first wheel 11 may wrap a portion or all of the clutch unit 110.

The sun gear 120 is directly connected with the first motor 101 or may be connected by one or more transmission gears 114 and 115.

A plurality of gear teeth 133 may be formed on an inner circumferential surface of the ring gear 130.

And, the ring gear 130 may include one or more wheel fastening portions 131 for being fastened with the first wheel 11. Therefore, when the first motor 101 is operating and the ring gear 130 is rotated by the sun gear 120 and the plurality of planetary gears 150, 152 and 154, the first wheel 11 is rotated with the ring gear 130.

The cleaner body 10 may further include a motor supporter 111 for supporting the first motor 101. The motor supporter 111 may be fixed to one side of the cleaner body 10.

The motor supporter 111 may include a receiving portion 112 for receiving the first motor 101.

In the case in which the first motor 101 is connected with the sun gear 120 by the one or more transmission gears 114 and 115, an axis of the first motor 101 or the one or more transmission gears 114 and 115 may penetrate the receiving portion 112 while the first motor 101 is received in the receiving portion 112.

At least a portion of the sun gear 120 may be positioned in a space 132 in which the ring gear 130 is formed while being connected to the first motor 101, and a center of the sun gear 120 forms a concentric with a center of the ring gear 130.

An outer diameter of the sun gear 120 is formed smaller than an inner diameter of the ring gear 130. Therefore, an outer circumferential surface of the sun gear 120 is spaced apart from the inner circumferential surface of the ring gear 130.

The plurality of planetary gears 150, 152 and 154 may be positioned in a space between the outer peripheral surface of the sun gear 120 and the inner peripheral surface of the ring gear 130.

The plurality of planetary gears 150, 152 and 154 may include a moving planetary gear 150 maintaining a connected state with the sun gear 120, and a plurality of fixed planetary gears 152 and 154 maintaining a connected state with the ring gear 130.

The moving planetary gear 150 not only rotates when the sun gear 120 is rotated, but also may revolve around the center of rotation of the sun gear 120.

Positions of the plurality of fixed planetary gears 152 and 154 may be fixed regardless of whether the first motor 101 is operated.

In one example, each of the fixed planetary gears 152 and 154 may rotate around fixed shafts 153 and 155, and the fixed shafts 153 and 155 may maintain a fixed state to the motor supporter 111 or the cleaner body 10.

The plurality of fixed planetary gears 152 and 154 may include a first fixed planetary gear 152 connected with the moving planetary gear 150 when the first motor 101 is rotated in a first direction, and a second fixed planetary gear 154 connected with the moving planetary gear 150 when the first motor 101 is rotated in a second direction which is an opposite direction to the first direction.

Each of the fixed planetary gears 152 and 154 is disposed to be spaced apart in a predetermined interval, and the moving planetary gear 150 may be positioned between the first fixed planetary gear 152 and the second fixed planetary gear 154.

While the moving planetary gear 150 is positioned between the first fixed planetary gear 152 and the second fixed planetary gear 154, according to a position of the moving planetary gear 150, the moving planetary gear 150 is connected to any one of the first fixed planetary gear 152 and the second fixed planetary gear 154 or the connection with each of the fixed planetary gears 152 and 154 may be released.

That is, the moving planetary gear 150 may move between a first position connected with the first fixed planetary gear 152 and a second position connected with the second fixed planetary gear 154, and at a position away from the first position and the second position, the moving planetary gear 150 may be in a state in which a connection with the first fixed planetary gear 152 and the second fixed planetary gear 154 is released.

At this time, a shortest distance between the first fixed planetary gear 152 and the second fixed planetary gear 154 may be formed larger than a diameter of the moving planetary gear 150 so that the moving planetary gear 150 may be spaced apart from the first fixed planetary gear 152 and the second fixed planetary gear 154.

And, while the moving planetary gear 150 is connected with the sun gear 120, the moving planetary gear 150 is spaced apart from the gear tooth 133 of the ring gear 130. That is, while the moving planetary gear 150 is connected with the sun gear 120, the moving planetary gear 150 is not directly connected with the ring gear 130.

As in FIG. 6, while the moving planetary gear 150 is disconnected from the first fixed planetary gear 152 and the second fixed planetary gear 154, even when the ring gear 130 is rotated by a rotation of the first wheel 11, a rotational force of the ring gear 130 is not transmitted to the moving planetary gear 150.

That is, the ring gear 130 is in an idle state with respect to the moving planetary gear 150 and the sun gear 120, and in this state, since the first motor 101, the sun gear 120 and the moving planetary gear 150 do not resist rotation of the first wheel 11, the resistance applied to the first wheel 11 is minimized, and thus the first wheel 11 may be rotated smoothly.

And, each of the plurality of fixed planetary gears 152 and 154 may be spaced apart from the sun gear 120.

The clutch unit 110 may further include an operation member 140 supporting and moving together with the moving planetary gear 150.

The operation member 140 may rotate around the center of rotation of the sun gear 120. The operation member 140 may include a hole 142 for penetration of the axis of the sun gear 120.

A shaft 144 rotatably supporting the moving planetary gear 150 may be provided in the operation member 140. The shaft 144 is integrally formed on the operation member 140 or may be coupled to the operation member 140.

At this time, the shaft 144 may be disposed to be spaced apart from the center of the sun gear 120 so that the moving planetary gear 150 may revolve around the center of rotation of the sun gear 120.

The moving planetary gear 150 may be in contact with the operation member 140 while the moving planetary gear 150 is connected to the shaft 144. At this time, the clutch unit 110 may further include a friction imparting member 148 so that a contact friction force between the moving planetary gear 150 and the operation member 140 (which may be called a "first frictional force") may be maintained in a constant frictional force.

In one example, the friction imparting member 148 may be a resilient member providing a resilient force to the moving planetary gear 150 in a direction in which the moving planetary gear 150 approaches to the operation member 140.

In one example, the resilient member may be a coil spring or a leaf spring, and may press the moving planetary gear 150 to the operation member 140 side. That is, at least a portion of the moving planetary gear 150 may be positioned between the friction imparting member 148 and the operation member 140.

In this case, the shaft 144 may be coupled with a cap 146 for preventing the resilient member from being separated.

In another example, the friction imparting member 148 may be positioned between the moving planetary gear 150 and the operation member 140, and may be formed of a rubber material.

In the case in which the contact friction force between the moving planetary gear 150 and the operation member 140 is maintained in a certain frictional force, a rotational force is transmitted to the moving planetary gear 150 by the sun gear 120, and the operation member 140 may rotate around the center of rotation of the sun gear 120 while the moving planetary gear 150 is not rotating.

Meanwhile, the operation member 140 may be in contact with a surrounding structure, for example, the sun gear 120 and/or the motor supporter 111.

At this time, the first frictional force may be greater than a frictional force by the contact with the operation member 140 and the sun gear 120 and/or the motor supporter 111 (may be called a "second frictional force"), so that the operation member 140 may rotate together around the center of rotation of the sun gear 120 when the sun gear 120 is rotating.

If the first frictional force is greater than the second frictional force, in a state such as FIG. 6, when the sun gear 120 is rotated, only the moving planetary gear 150 is rotated while the operation member 140 is stopped.

In this case, since the moving planetary gear 150 is not connected with each of the fixed planetary gears 152 and 154, the rotational force of the sun gear 120 is not transmitted to the fixed planetary gears 152 and 154, and thus all the wheels 11 and 12 are not rotated.

The clutch unit 110 may further include a guide member 160 for guiding the movement of the operation member 140.

The guide member 160 may include a fastening portion 162 for being coupled to the motor supporter 111. At this time, the guide member 160 may be fastened to the motor supporter 111 by the fixed shafts 153 and 155. That is, the fixed shafts 153 and 155 may be fastened to the fastening portion 162.

Also, the guide member 160 may include a guide slot 164 for penetration of the shaft 144. The guide slot 164 may be formed in an arc shape for preventing interference with the shaft 144 when the operation member 140 is rotated around the center of the sun gear 120.

The motor supporter 111 may further include a guide slot 113 through which the shaft 144 is penetrated.

Hereinafter, the operation of the vacuum cleaner is disclosed.

FIG. 7 is a view illustrating the operation of the clutch unit when the vacuum cleaner according to an embodiment of the present invention moves forward, FIG. 8 is a view illustrating the operation of the clutch unit when the vacuum cleaner according to an embodiment of the present invention moves backward, and FIG. 9 is a view illustrating the connection of the motor and the wheel is released by the clutch unit.

In FIG. 9, a position of the moving planetary gear 150 while a connection between the motors 101 and 102 and the wheels 11 and 12 are released by the clutch unit 110 may be named as a neutral position.

Referring to FIG. 7 to FIG. 9, in the process of performing a cleaning by using the vacuum cleaner 1 while the vacuum cleaner 1 is turned on, an ultrasonic wave is transmitted from the ultrasonic wave transmitting part 50.

Then, the ultrasonic wave receiving part 60 receives the ultrasonic wave transmitted from the ultrasonic wave transmitting part 50.

The control part 70 may determine a distance value of the ultrasonic wave transmitting part 50 and each of the receiving parts 61, 62 and 63 based on the ultrasonic wave received from each of the receiving parts 61, 62 and 63. And, the control part 70 may determine a position of the ultrasonic wave transmitting part 50 by using the determined three distance values. And the control part 70 may determine whether the movement of the cleaner body 10 is needed based on the position of the ultrasonic wave transmitting part 50.

According to an embodiment, in one example, in the case in which the movement of the cleaner body 10 is needed is a case in which a distance from the ultrasonic wave transmitting part 50 to the cleaner body 10 is equal to or more than a first reference distance. Here, a reference distance may be varied according to the length of a connecting hose.

That is, in the case in which the first motor 101 and the second motor 102 are not operated, the cleaner body 10 maintains a suspended state. In this state, since the handle 22 moves in the process of performing cleaning by using the suction unit 20, the position of the ultrasonic wave transmitting part 50 is consistently changed. In one example, when the handle 22 is moved in a forward/backward direction, the position of the ultrasonic wave transmitting part 50 may also be varied in the forward/backward direction.

And, when the distance from the ultrasonic wave transmitting part 50 to the cleaner body 10 is more than the first reference distance, the movement of the cleaner body 10 is needed.

When the movement of the cleaner body 10 is needed, the control part 70 operates one or more motors of the first motor 101 and the second motor 102.

As in FIG. 7, when the motors 101 and 102 are rotated in the first direction (in one example, a clockwise direction in the figure), the rotational force of the motors 101 and 102 is transmitted to the sun gear 120 and the sun gear 120 is rotated in the clockwise direction.

When the sun gear 120 is rotated in the clockwise direction, the rotational force of the sun gear 120 is transmitted to the moving planetary gear 150 and the operation member 140 is rotated in a counter-clockwise direction around the center of rotation of the sun gear 120.

At this time, as described above, since the first frictional force between the moving planetary gear 150 and the operation member 140 is greater than the second frictional force between the operation member 140 and the surrounding structure, when the sun gear 120 is rotated, the operation member 140 may be rotated in the counter-clockwise direction around the center of the sun gear 120 while the moving planetary gear 150 is stopped.

In the process of rotating the operation member 140 in the counter-clockwise direction, the moving planetary gear 150 is connected to the first fixed planetary gear 152 and the shaft 144 is in contact with one end of the guide slots 113 and 164, and thus the rotation of the operation member 140 is stopped.

While the moving planetary gear 150 is connected to the first fixed planetary gear 152, since the operation member 140 cannot be further rotated, the moving planetary gear 150 is rotated in the counter-clockwise direction by the rotational force of the sun gear 120, and the first fixed planetary gear 152 connected with the moving planetary gear 150 may be rotated in the clockwise direction.

When the first fixed planetary gear 152 is rotated in the clockwise direction, since the ring gear 130 is rotated in the clockwise direction, the wheels 11 and 12 may be rotated in the clockwise direction with the ring gear 130.

When the wheels 11 and 12 are rotated in the clockwise direction, the cleaner body 10 may move forward.

Meanwhile, as in FIG. 8, when the motors 101 and 102 are rotated in the second direction (in one example, a counter-clockwise direction in the figure), the rotational force of the motors 101 and 102 is transmitted to the sun gear 120 and the sun gear 120 is rotated in the counter-clockwise direction.

When the sun gear 120 is rotated in the counter-clockwise direction, the rotational force of the sun gear 120 is transmitted to the moving planetary gear 150 and the operation member 140 is rotated in the clockwise direction around the center of the sun gear 120.

At this time, as described above, since the first frictional force between the moving planetary gear 150 and the operation member 140 is greater than the second frictional force between the operation member 140 and the surrounding structure, when the sun gear 120 is rotated, the operation member 140 may be rotated in the clockwise direction around the center of the sun gear 120 while the moving planetary gear 150 is stopped.

In the process of rotating the operation member 140 in the clockwise direction, the moving planetary gear 150 is connected to the second fixed planetary gear 154 and the shaft 144 is in contact with the other end of the guide slots 113 and 164, and thus the rotation of the operation member 140 is stopped.

Since the operation member 140 cannot be rotated any more while the moving planetary gear 150 is connected to the second fixed planetary gear 154, the moving planetary gear 150 is rotated in the clockwise direction by the rotational force of the sun gear 120, and the second fixed planetary gear 154 connected to the moving planetary gear 150 may be rotated in the counter-clockwise direction.

When the second fixed planetary gear 154 is rotated in the counter-clockwise direction, the ring gear 130 is rotated in the counter-clockwise direction and the wheels 11 and 12 may be rotated in the counter-clockwise direction with the ring gear 130.

When the wheels 11 and 12 are rotated in the counter-clockwise direction, the cleaner body 10 may move backward.

In FIG. 7 and FIG. 8, each of the wheels 11 and 12 have been described to be rotated in the same direction; in contrast, when the directions of rotation of the two motors 101 and 102 are opposite to each other, the directions of rotation of the two wheels 11 and 12 are also opposite to each other, and the cleaner body 10 may turn to the right or left side.

Meanwhile, as in FIG. 7, the operation of the vacuum cleaner 1 may be stopped while the moving planetary gear 150 is connected to the first fixed planetary gear 152.

In this state, when the user exerts a force for reversing the cleaner body 10 to the cleaner body 10, the wheels 11 and 12 are rotated in a reverse direction, and accordingly, the ring gear 130 is rotated in the counter-clockwise direction based on FIG. 7.

When the ring gear 130 is rotated in the counter-clockwise direction, the first fixed planetary gear 152 is rotated in the counter-clockwise direction, and the rotational force of the first fixed planetary gear 152 is transmitted to the moving planetary gear 150.

At this time, as described above, since the first frictional force between the moving planetary gear 150 and the operation member 140 is greater than the second frictional force between the operation member 140 and the surrounding structure, even when the rotational force of the first fixed planetary gear 152 is transmitted to the moving planetary gear 150, the moving planetary gear 150 does not rotate, and the operation member 140 is rotated in the clockwise direction around the center of rotation of the sun gear 120. Then, the moving planetary gear 150 moves to the neutral position as shown in FIG. 9, the connection of the moving planetary gear 150 and the first fixed planetary gear 152 is released.

Also as shown in FIG. 8, the operation of the vacuum cleaner 1 may be stopped while the moving planetary gear 150 is connected to the second fixed planetary gear 154.

In this state, when the user exerts a force for advancing the cleaner body 10 to the cleaner body 10, the wheels 11 and 12 are rotated in an advance direction, and accordingly, the ring gear 130 is rotated in the clockwise direction based on FIG. 8.

When the ring gear 130 is rotated in the clockwise direction, the second fixed planetary gear 154 is rotated in the clockwise direction, and the rotational force of the second fixed planetary gear 154 is transmitted to the moving planetary gear 150.

At this time, as described above, since the first frictional force between the moving planetary gear 150 and the operation member 140 is greater than the second frictional force between the operation member 140 and the surrounding structure, even when the rotational force of the second fixed planetary gear 154 is transmitted to the moving planetary gear 150, the moving planetary gear 150 does not rotate and the operation member 140 is rotated in the counter-clockwise direction around the center of rotation of the sun gear 120. Then, the moving planetary gear 150 moves to the neutral position as shown in FIG. 9, and the connection of the moving planetary gear 150 and the second fixed planetary gear 154 is released.

While the moving planetary gear 150 is moved to the neutral position, the wheels 11 and 12 of the cleaner body 10 may be smoothly rotated by the moving force provided by the user.

Meanwhile, as shown in FIG. 7, when the operation of the vacuum cleaner 1 is stopped, in the case in which the user exerts a force for advancing the cleaner body 10 to the cleaner body 10, the wheels 11 and 12 are rotated in the advance direction. The ring gear 130 should be rotated in the clockwise direction based on FIG. 7 for rotating the wheels 11 and 12 in the advance direction.

However, for rotating the ring gear 130 in clockwise direction, the first fixed planetary gear 152 should be rotated in the clockwise direction, and the moving planetary gear 150 should be rotated in the counter-clockwise direction. However, since the sun gear 120 connected to the moving planetary gear 150 is stopped, after all, the moving planetary gear 150, the first fixed planetary gear 152 and the ring gear 130 may not be rotated, and thus the wheels 11 and 12 may not be rotated.

Also, as in FIG. 8, when the operation of the vacuum cleaner 1 is stopped, in the case in which the user exerts a force for reversing the cleaner body 10 to the cleaner body 10, the wheels 11 and 12 are rotated in the reverse direction. The ring gear 130 should be rotated in the counter-clockwise direction based on FIG. 8 for rotating the wheels 11 and 12 in the reverse direction.

However, the second fixed planetary gear 154 should be rotated in the counter-clockwise direction for rotating the ring gear 130 in the counter-clockwise direction, and the moving planetary gear 150 should be rotated in the clockwise direction. However, since the sun gear 120 connected to the moving planetary gear 150 is stopped, after all, the moving planetary gear 150, the second fixed planetary gear 154 and the ring gear 130 may not be rotated, and accordingly the wheels 11 and 12 may not be rotated.

Therefore, in the present invention, when the operation of the vacuum cleaner 1 is stopped while the motors 101 and 102 are operated in one direction so that the cleaner body 10 may smoothly move in any direction while the operation of the vacuum cleaner 1 is stopped, the motors 101 and 102 are stopped after being rotated for a predetermined angle or a predetermined time so that the moving planetary gear 150 moves to the neutral position.

For example, as in FIG. 7, when the motors 101 and 102 are stopped while the motors 101 and 102 are rotated in the first direction (in one example, the clockwise direction in the figure), the control part 70 may control the motors 101 and 102 so that the motors 101 and 102 are stopped after being rotated for a predetermined angle or a predetermined time in the second direction.

Also, an in FIG. 8, in the case in which the motors 101 and 102 are stopped while the motors 101 and 102 are rotated in the second direction (in one example, the counter-clockwise direction in the figure), the control part 70 may control the motors 101 and 102 so that the motors 101 and 102 are stopped after being rotated for a predetermined angle or a predetermined time in the first direction.

According to the proposed invention, since the cleaner body 10 may move to follow the movement of the user, the user does not need to move the cleaner body 10 directly, and thus there is an advantage of improving the usability.

Also, while the operation of the vacuum cleaner 1 is stopped, as the connection between the motors 101 and 102 and the wheels 11 and 12 is released by the clutch unit 110, the user may easily manually move the cleaner body 10.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in a descriptive sense only and not for purposes of limitation, and also the technical scope of the invention is not limited to the embodiments. Furthermore, the technical scope of the invention is defined not by the detailed description of the invention but by the appended claims, and all differences within the scope will be construed as being comprised in the present disclosure.

The invention claimed is:

1. A vacuum cleaner comprising:

a cleaner body;

a suction unit connected to the cleaner body, sucking dust and air and guiding the sucked dust and air, and having a handle;

a moving unit including a wheel and a motor to drive the wheel to move the cleaner body automatically; and a clutch unit to connect the motor and the wheel or release the connection between the motor and the wheel according to an operation state of the cleaner body, wherein the clutch unit includes a sun gear connected to the motor, a ring gear connected to the wheel, a plurality of fixed planetary gears disposed to be spaced apart from each other between the sun gear and the ring gear, and a moving planetary gear to transmit a rotational force transmitted to the sun gear to one gear of the plurality of fixed planetary gears.

2. The vacuum cleaner of claim 1, wherein the moving planetary gear is positioned between the plurality of fixed planetary gears.

3. The vacuum cleaner of claim 2, wherein the moving planetary gear is connected to the sun gear and spaced apart from a gear tooth of the ring gear.

4. The vacuum cleaner of claim 2, wherein each of the plurality of fixed planetary gears is engaged with a gear tooth of the ring gear and spaced apart from the sun gear.

5. The vacuum cleaner of claim 2, wherein a shortest distance between the plurality of fixed planetary gears is formed greater than a diameter of the moving planetary gear.

6. The vacuum cleaner of claim 1, wherein the plurality of fixed planetary gears include a first fixed planetary gear connected to the ring gear and a second fixed planetary gear connected to the ring gear, and the moving planetary gear may be connected to any one of the first and second fixed planetary gears, or the connection with both of the two fixed planetary gears may be released.

7. The vacuum cleaner of claim 6, wherein, when the motor is rotated in a first direction for advancing the cleaner body, the moving planetary gear and the first fixed planetary gear are connected, and when the motor is rotated in a second direction opposite to the first direction for reversing the cleaner body, the moving planetary gear and the second fixed planetary gear are connected.

8. The vacuum cleaner of claim 7, wherein, when a force for reversing the cleaner body is exerted by a user while the moving planetary gear and the first fixed planetary gear are connected, the moving planetary gear is spaced apart from the first fixed planetary gear, and when a force for advancing the cleaner body is exerted by the user while the moving planetary gear and the second fixed planetary gear are connected, the moving planetary gear is spaced apart from the second fixed planetary gear.

9. The vacuum cleaner of claim 6, wherein the clutch unit further includes an operation member which supports the moving planetary gear and may be rotated around a center of the sun gear, and the moving planetary gear may move to a position connected with any one of the first and second fixed planetary gears or may move to a position not connected with either of the two fixed planetary gears by the rotation of the operation member.

10. The vacuum cleaner of claim 9, wherein the clutch unit further includes a friction imparting member so that a contact friction force between the moving planetary gear and the operation member is maintained in a constant frictional force.

11. The vacuum cleaner of claim 10, wherein the friction imparting member is a resilient member pressing the moving planetary gear in a direction in which the moving planetary gear and the operation member move closer.

12. The vacuum cleaner of claim 10, wherein the friction imparting member is disposed between the moving planetary gear and the operation member and formed of a rubber material.

13. The vacuum cleaner of claim 9, wherein the operation member includes a shaft rotatably supporting the moving planetary gear, and the clutch unit further includes a guide member having a guide slot guiding the shaft when the operation member is rotated around the center of the sun gear.

14. The vacuum cleaner of claim 9, further comprising a motor supporter to support the motor and fixed to the cleaner body, wherein the motor supporter includes a guide slot to guide the shaft when the operation member is rotated around the center of the sun gear.

15. The vacuum cleaner of claim 1, further comprising a control part to control the motor, wherein in the operation process of the cleaner body, if the operation of the cleaner body is stopped while the motor is rotated in a first direction, the control part controls the motor so that the motor is stopped after being rotated for a predetermined angle or predetermined time in a second direction opposite to the first direction.

16. A vacuum cleaner comprising:

a cleaner body;

a suction unit connected to the cleaner body, sucking dust and air and guiding the sucked dust and air to the cleaner body, and having a handle;

a moving unit including a wheel and a motor to drive the wheel to automatically move the cleaner body;

a sun gear to receive power from the motor;

a ring gear connected to the wheel;

a first fixed planetary gear disposed between the sun gear and the ring gear;

a second fixed planetary gear disposed to be spaced apart from the first fixed planetary gear between the sun gear and the ring gear; and a moving planetary gear connected to the first fixed planetary gear if the motor is rotated in a first direction, and connected to the second fixed planetary gear if the motor is rotated in a second direction opposite to the first direction.

17. The vacuum cleaner of claim 16, further comprising an operation member to which the moving planetary gear is rotatably connected and which may be rotated around a center of the sun gear.

18. The vacuum cleaner of claim 17, further comprising a friction imparting member for maintaining a contact friction force between the moving planetary gear and the operation member in a certain frictional force.

19. The vacuum cleaner of claim 16, wherein the moving planetary gear is spaced apart from the ring gear and each of the fixed planetary gears is spaced apart from the sun gear.

20. The vacuum cleaner of claim 16, wherein the moving planetary gear is positioned between the first fixed planetary gear and the second fixed planetary gear, and a shortest distance between the first fixed planetary gear and the second fixed planetary gear is formed greater than a diameter of the moving planetary gear.

* * * * *